US005519918A

United States Patent [19]

Chang

[11] Patent Number: 5,519,918

[45] Date of Patent: May 28, 1996

[54] MULTIFUNCTIONAL SPRING-GRIP DUMB-BELL

[76] Inventor: John Chang, No. 1-2, Lane 975, Chun-Jih Road, Tao-Yuan City, Taiwan

[21] Appl. No.: 409,073

[22] Filed: Mar. 22, 1995

Related U.S. Application Data

[63] Continuation-in-part of Ser. No. 254,901, Jun. 6, 1994, Pat. No. 5,488,755.

[51] Int. Cl.[6] ..... A47B 95/02

[52] U.S. Cl. ..... 16/111 R; 482/49; 16/DIG. 12

[58] Field of Search ..... 116/111 R, 110 R, 116/110.5, DIG. 12; 482/49, 128

[56] References Cited

U.S. PATENT DOCUMENTS

| | | | |
|---|---|---|---|
| 4,577,858 | 3/1986 | Higami | 482/44 |
| 5,147,256 | 9/1992 | Silagy | 482/47 |

*Primary Examiner*—Chuck Y. Mah

*Attorney, Agent, or Firm*—Morton J. Rosenberg; David I. Klein

[57] ABSTRACT

A multifunctional spring-grip dumb-bell including a fist base frame and a second base frame symmetrically disposed in a diagonal manner, each base frame comprising an axle and a supporting bar extended from one end of the axle at right angles; a first locating member and a second locating member symmetrically disposed in a diagonal manner, each locating member having a first end connected to the axle of the first base frame and a second end linked to the supporting bar of the second base frame; first spring means connected between the supporting bar of the first base frame and the second end of the second locating member; second spring means connected between the supporting bar of the second base frame and the second end of the second locating member; two barrels respectively turned round the axles of the first and second base frames for the holding of the hand; two locking means respectively mounted on the locating members and controlled to lock the barrels in position, prohibiting the barrels from rotary motion relative to the axles of the first and second base frames; and two covers respectively fastened to the locating members by screws.

10 Claims, 16 Drawing Sheets

MULTIFUNCTIONAL SPRING-GRIP DUMB-BELL

CROSS-REFERENCE OF RELATED APPLICATION

This is a continuation-in-part of parent application Ser. No. 08/254,901, filed Jun. 6, 1994, entitled "MULTIFUNCTIONAL HANDGRIP", now U.S. Pat. No. 5,488,755.

BACKGROUND OF THE INVENTION

FIG. 1 shows a spring-grip dumb-bell according to the prior art which is comprised of two hand grips 11 joined by a spring member 12. This structure of spring-grip dumb-bell is specifically designed for developing the muscles of the hand. However, it can only be used to exercise one hand at a time. Furthermore, this structure of spring-grip dumb-bell cannot be adjusted to fit people of different ages because the spring force of the spring member is not adjustable. Therefore, old people usually use metal balls 13 to exercise the hand by holding the metal balls 13 in hand and then moving the fingers to turn the metal balls 13 against each other. However, because these metal balls are rounded and heavy, they are inconvenient to carry with oneself.

In order to eliminate the aforesaid drawbacks, the inventor invented a multi-functional handgrip and filed for a patent under application Ser. No. 08/254,901 which comprises a pair of U-shaped frames slidably engaged with each other through the inserts and connecting blocks disposed at both ends, wherein each connecting block is provided with a spring member, which gives a biasing force to the respective insert; a holding bar is disposed at the U-shaped frames for grasping. This structure of multi-functional handgrip is functional, however it still has drawbacks. One drawback of this structure of multi-functional handgrip is that the U-shaped frames are expensive to manufacture and complicated to assembled. Another drawback of this structure of multi-functional handgrip is that the holding bar and the spring members are securely fixed to the U-shaped frames and not replaceable. Therefore, the hardness of the holding bar cannot be changed to fit different requirements.

SUMMARY OF THE INVENTION

The present invention has been accomplished under the circumstances in view. It is one object of the present invention to provide a multifunctional spring-grip dumb-bell which is inexpensive to manufacture and easy to assemble. It is another object of the present invention to provide a multifunctional spring-grip dumb-bell which can be conveniently adjusted to fit different requirements.

According to one aspect of the present invention, the multifunctional spring-grip dumb-bell comprises a fist base frame and a second base frame symmetrically disposed in a diagonal manner, each base frame comprising an axle and a supporting bar extended from one end of the axle at right angles; a first locating member and a second locating member symmetrically disposed in a diagonal manner, each locating member having a first end connected to the axle of the first base frame and a second end linked to the supporting bar of the second base frame; first spring means connected between the supporting bar of the first base frame and the second end of the second locating member; second spring means connected between the supporting bar of the second base frame and the second end of the second locating member; two barrels respectively turned round the axles of the first and second base frames for the holding of the hand; and two covers respectively fastened to the locating members by screws.

According another aspect of the present invention, two spring-supported and ON/OFF sliding switch controlled stop bolts are respectively mounted on the locating members and controlled to lock the barrels in position, prohibiting the barrels from rotary motion relative to the axles of the first and second base frames.

BRIEF DESCRIPTION OF THE DRAWINGS

FIG. 9A is a sectional assembly view of FIG. 9;

FIG. 9B is similar to FIG. 9A but showing the press-button depressed and the raised portions of the axle disengaged from the stop edge inside the rectangular mounting hole of the locating member;

FIGS. 17, 18 and 18A show the multifunctional spring-grip dumb-bell used as a palm massager.

DETAILED DESCRIPTION OF THE PREFERRED EMBODIMENT

Figure 1:
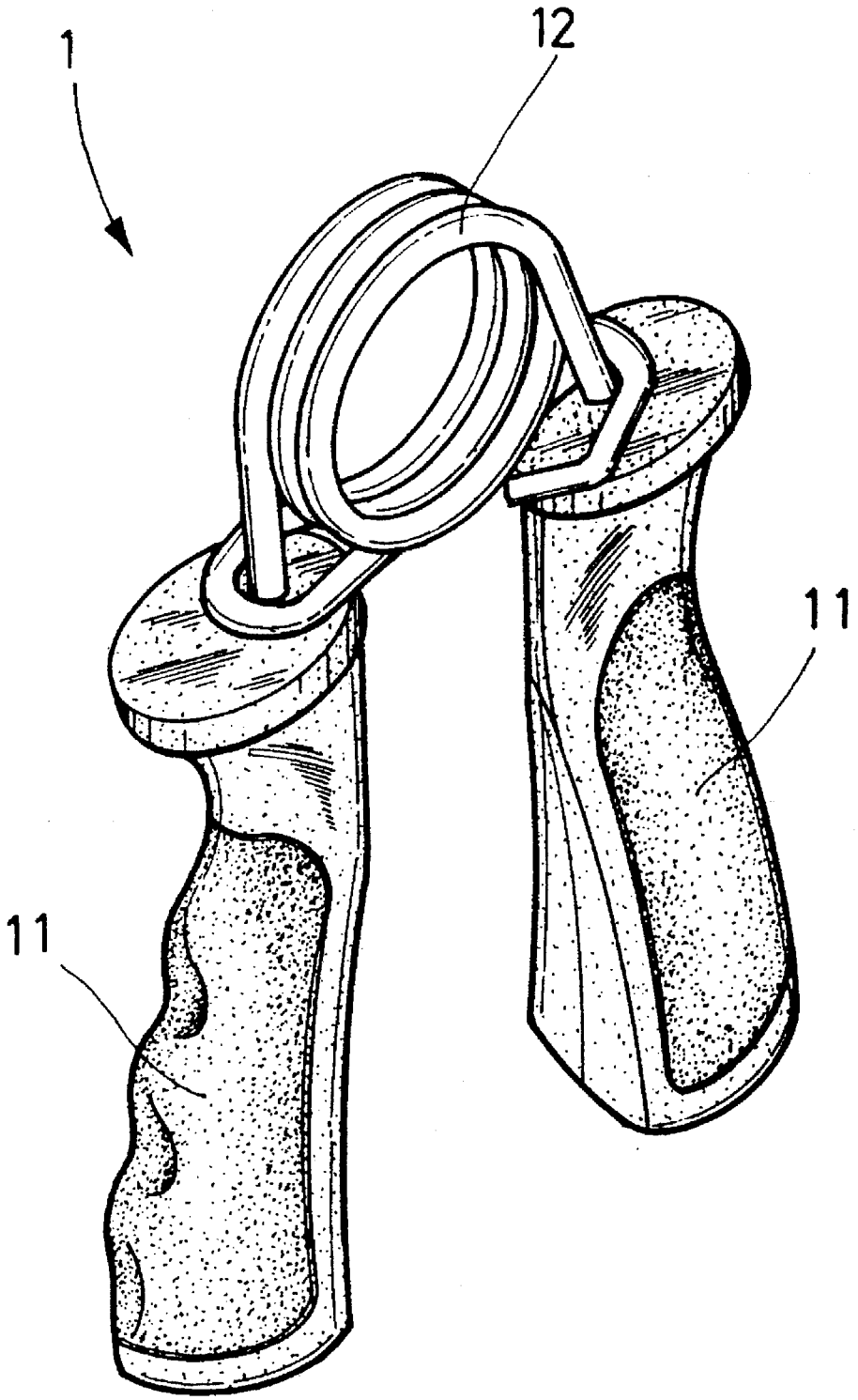
PRIOR ART FIG. 1
FIG. 1 is an elevational view of a spring-grip dumb-bell according to the prior art.
Figure 2:
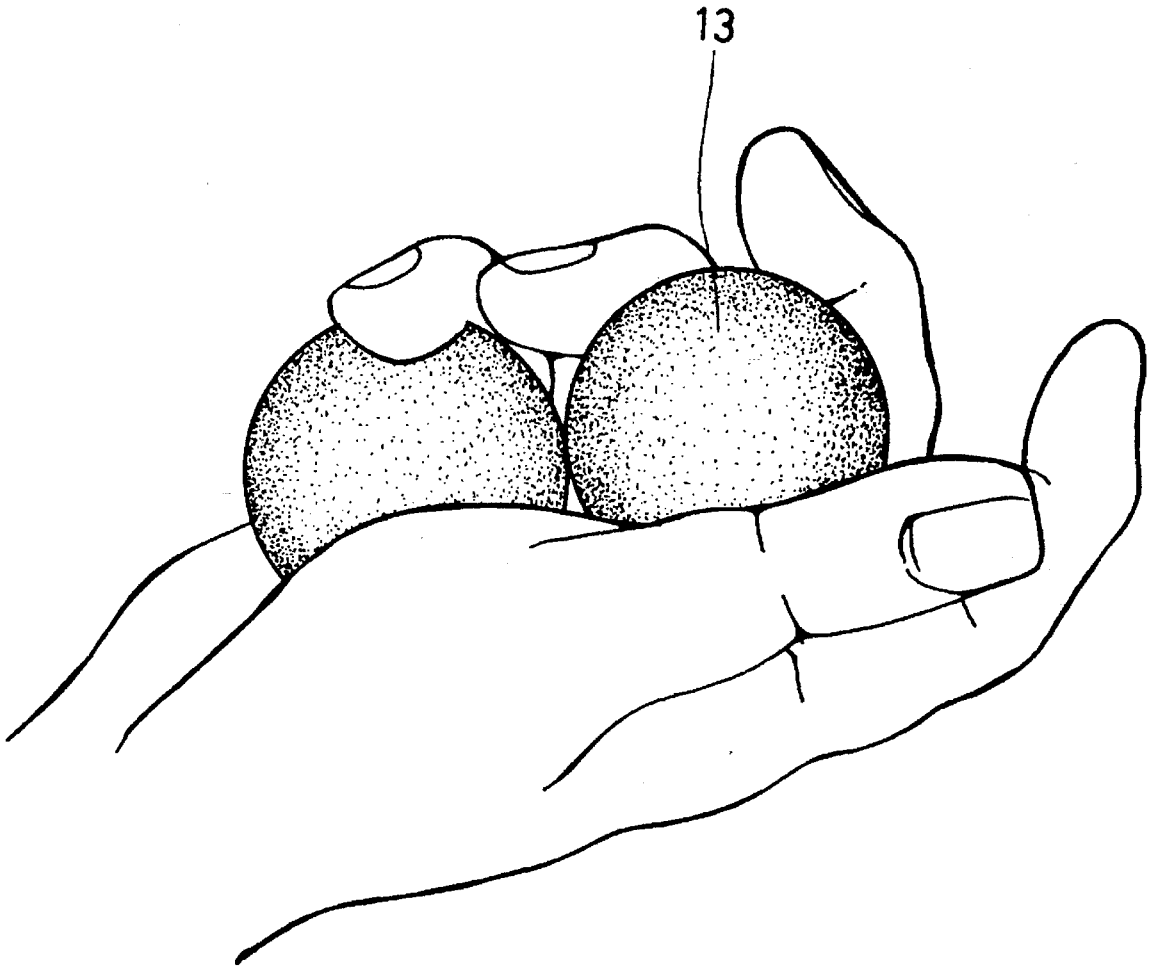
PRIOR ART FIG. 2
FIG. 2 shows two metal balls turned in the hand against each other.
Figure 3:
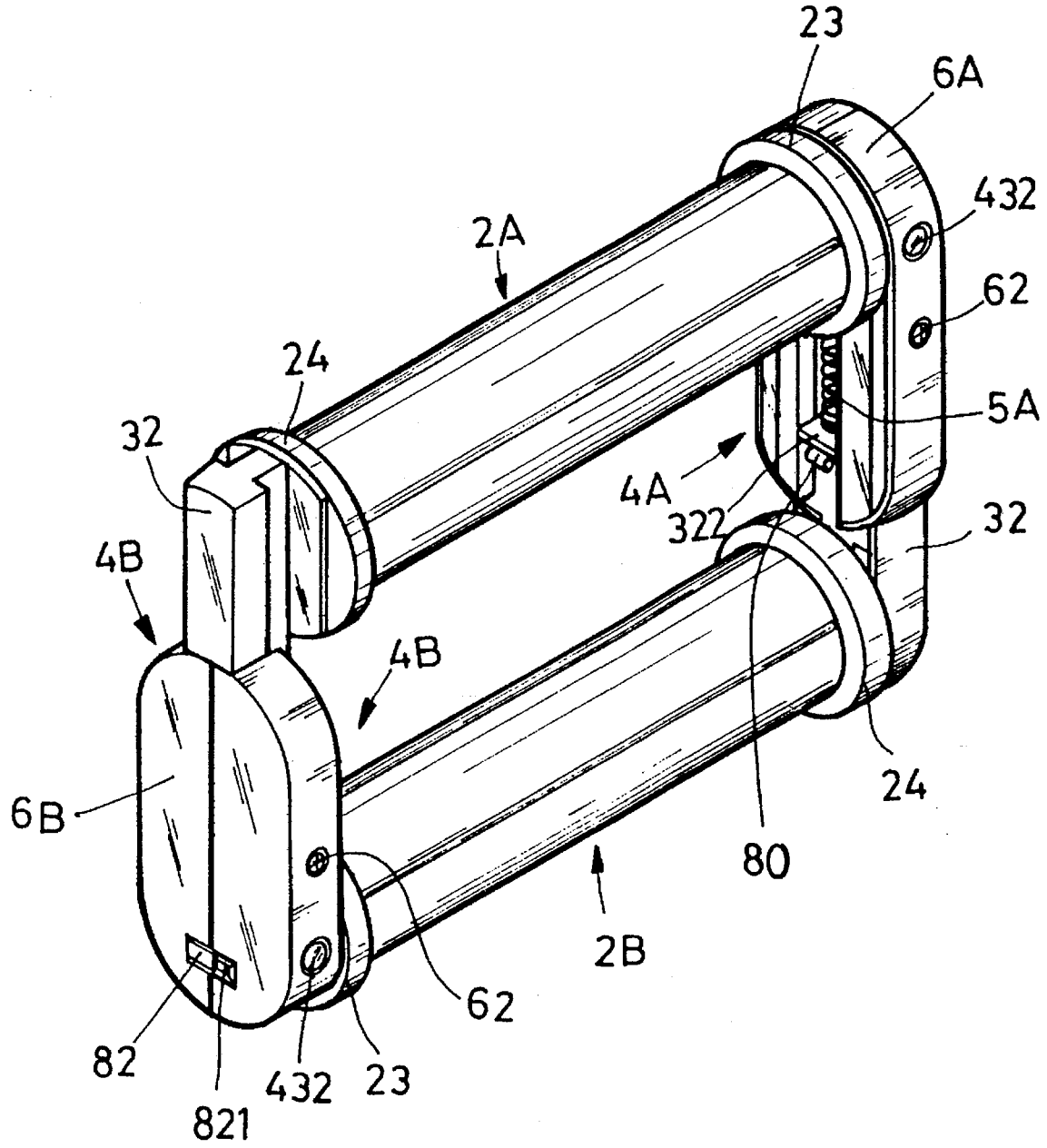
FIG. 3 is an elevational view of a multifunctional spring-grip dumb-bell according to the present invention.
Figure 4:
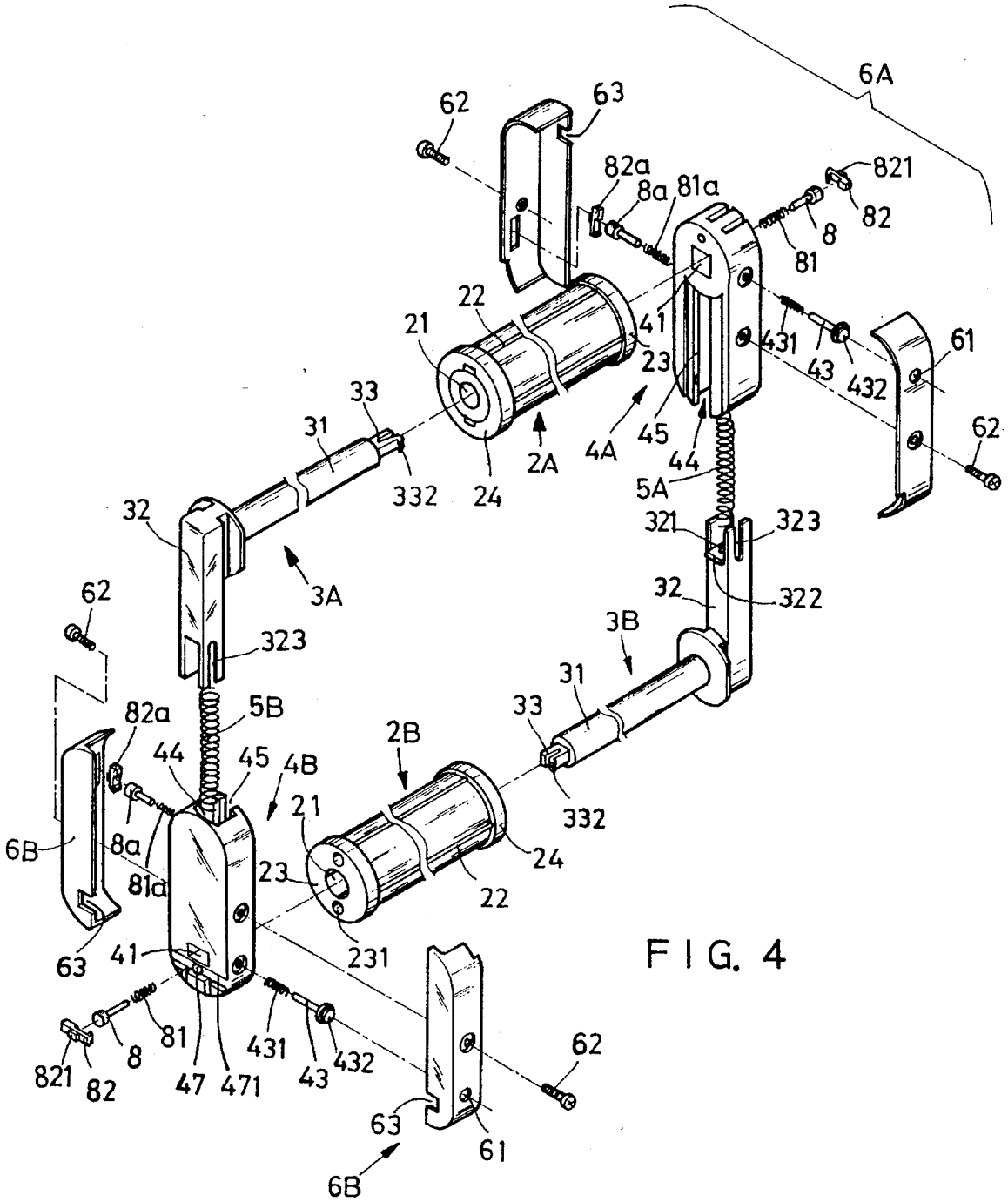
FIG. 4 is an exploded view of the multifunctional spring-grip dumb-bell shown in FIG. 3.

Referring to FIGS. 3 and 4, a multifunctional spring-grip dumb-bell in accordance with the present invention is generally comprised of a pair of barrels 2A and 2B, two symmetrical base frames 3A and 3B, two symmetrical locating members 4A and 4B, a pair of springs 5A and 5B, and two covers 6A and 6B. The barrels 2A and 2B are disposed in parallel, each having a longitudinal axle hole 21. The base frames 3A and 3B are disposed in a diagonal manner, each comprising an axle 31 inserted into the longitudinal axle hole 21 of one barrel 2A or 2B and a supporting bar 32 extended from one end of the axle 13 at right angles. The locating members 4A and 4B are disposed in a diagonal manner and respectively connected to the axles 31 of the base frames 3A and 3B. The springs 5A and 5B are respectively connected between the supporting bars 32 of the base frames 3A and 3*b* and the locating members 4A and 4B. The covers 6A and 6B are respectively fastened to the locating members 4A and 4B at an outer side by screws 62. When assembled, the base frames 3A and 3B and the locating members 4A and 4B are connected into a rectangular open frame, the barrels 2A and 2B are turned round the axles 31 of the base frames 3A and 3B and moved relative to each other.

Referring to FIGS. from 5 to 8, the barrel 2A or 2B comprises a plurality of longitudinal ribs 22 around the periphery, an outward flange 23 at one end defining a plurality of axial pin holes 231 around the longitudinal axle hole 21, an annular extension 25 at an opposite end, a key 251 and a hook 252 raised from the annular extension 25 at two opposite locations. A sleeve 7 is sleeved onto the barrel 2A or 2B. An annular end cap 24 is fastened to the annular extension 25 of the barrel 2A or 2B to hold down the sleeve 7. The annular end cap 24 comprises a center through hole 241, which receives the annular extension 25 of the barrel 2A or 2B, a key way 242 and a retaining groove 243 disposed on the inside wall thereof at two opposite locations and respectively engaged with the key 251 and the hook 252.

Figure 5:
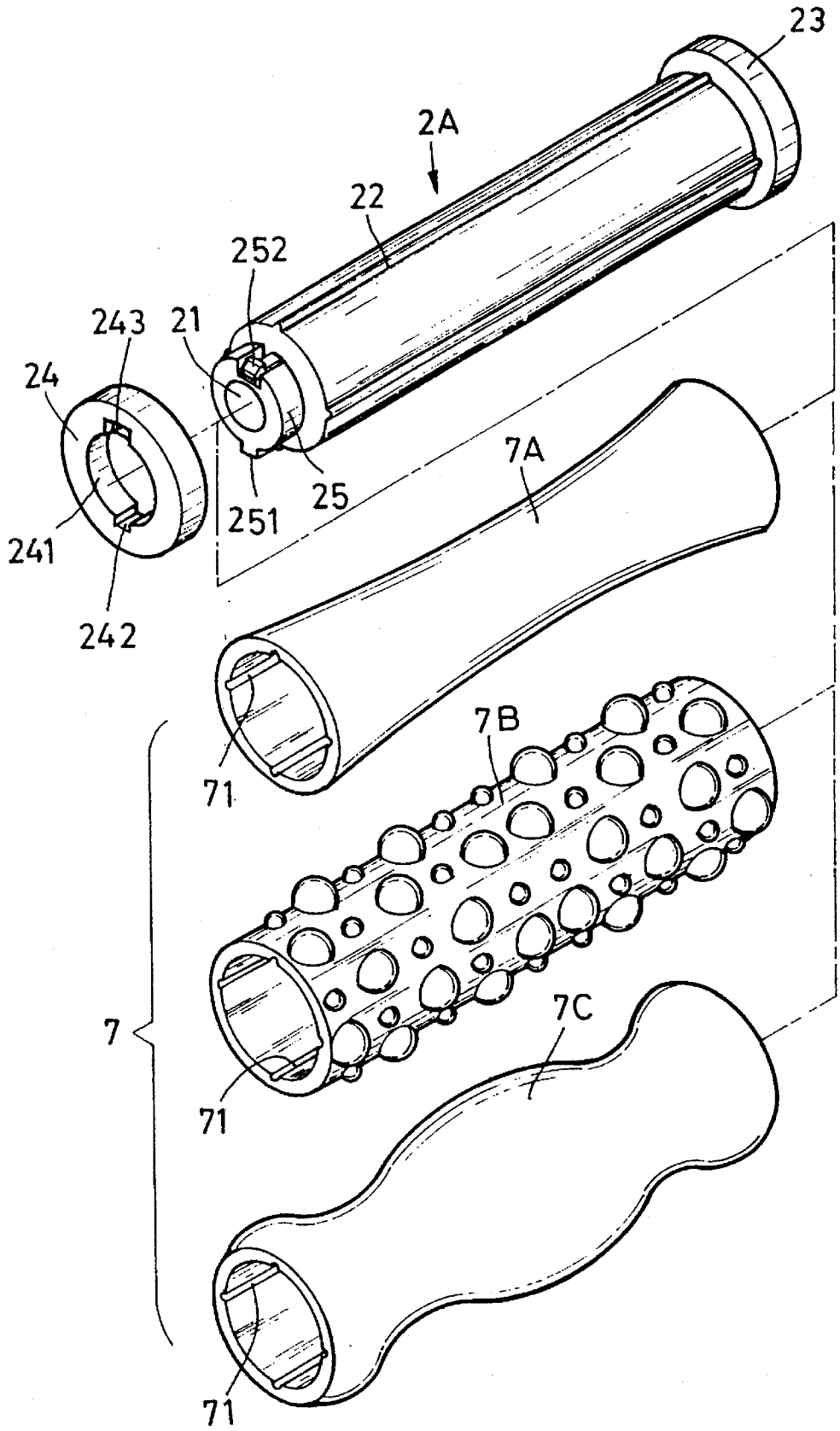
FIG. 5 is an exploded view of the barrel and the annular end cap and different forms of the sleeve according to the present invention.
Figure 6:
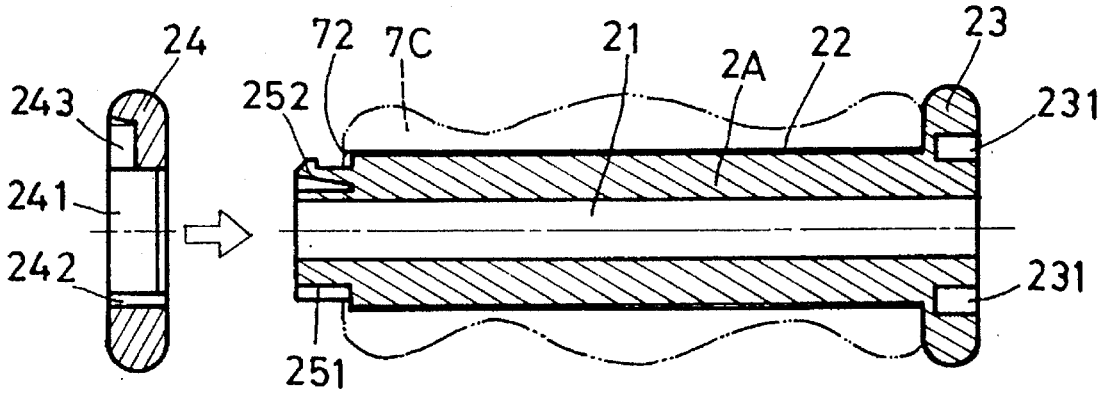
FIG. 6 is a longitudinal view in section of the barrel according to the present invention before the installation of the annular end cap.

Referring to FIG. 5 again, the sleeve 7 can be made in any of a variety of forms. The sleeve, referenced by 7A, is molded from flexible rubber, of which the outer diameter is made gradually bigger toward two opposite ends. The sleeve, referenced by 7B, has raised portions around the periphery for massaging the palm. The sleeve, referenced by 7C, has a wave-like outside wall. Either form of the sleeve 7 has a plurality of longitudinal grooves 71 for engagement with the longitudinal ribs 22 on the barrel 2A or 2B.

Figure 7:
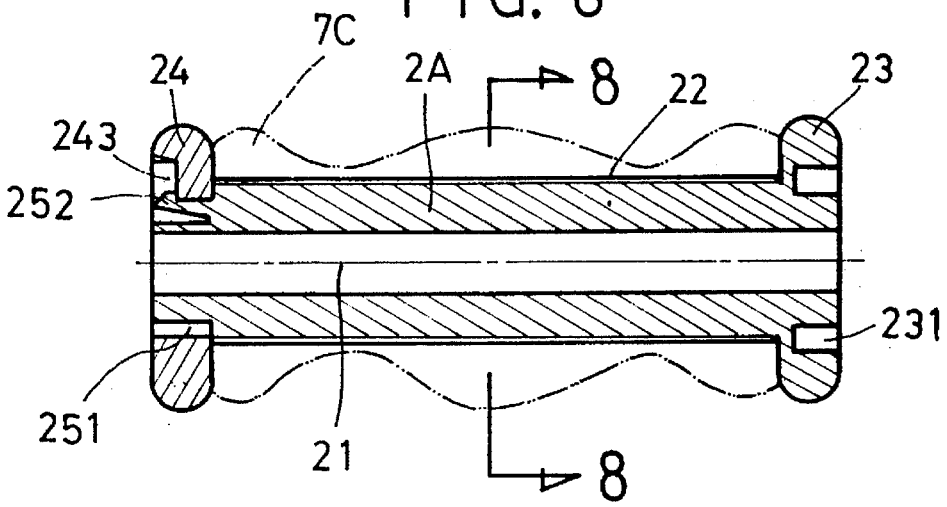
FIG. 7 is similar to FIG. 6 but showing the annular end cap installed.
Figure 8:
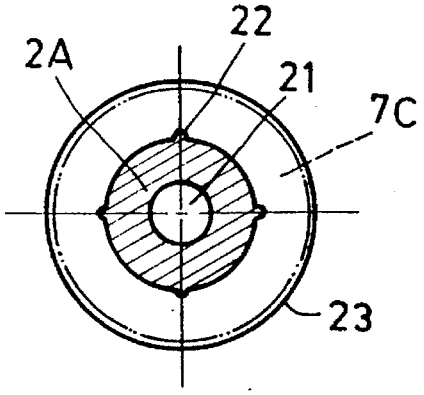
FIG. 8 is a cross sectional view taken along line 8—8 of FIG. 7.

Referring to FIGS. 7 and 8, when the sleeve 7 is sleeved onto the barrel 2A or 2B, the annular end cap 24 is fastened to the annular extension 25 to hold down the sleeve 7 in place. Because the longitudinal ribs 22 are respectively engaged with the longitudinal grooves 71, the sleeve 7 and the barrel 2A or 2B can be simultaneously turned round the axle 31.

Figure 9:
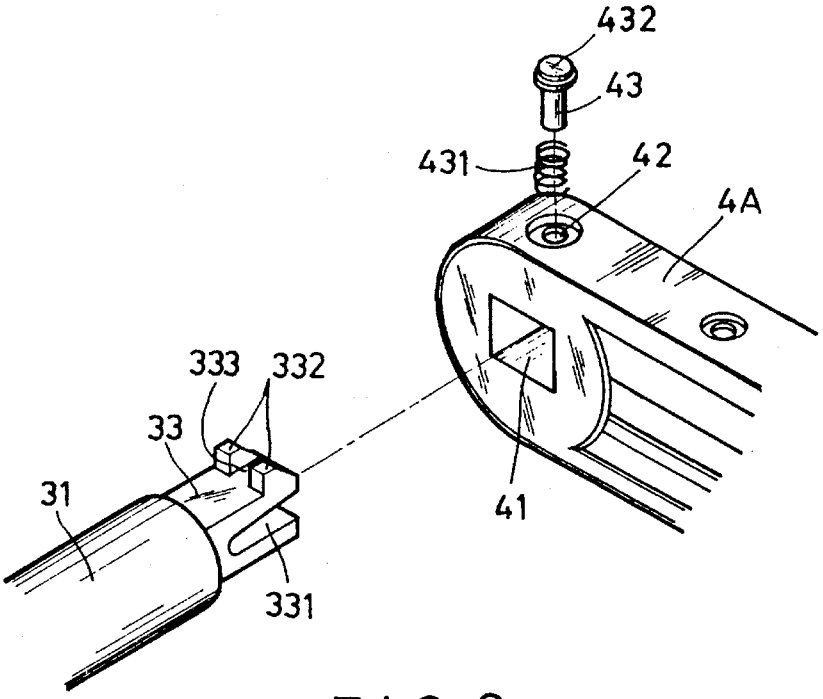
FIG. 9 is a dismantled view of the axle and the locating member according to the present invention.
Figure 9:
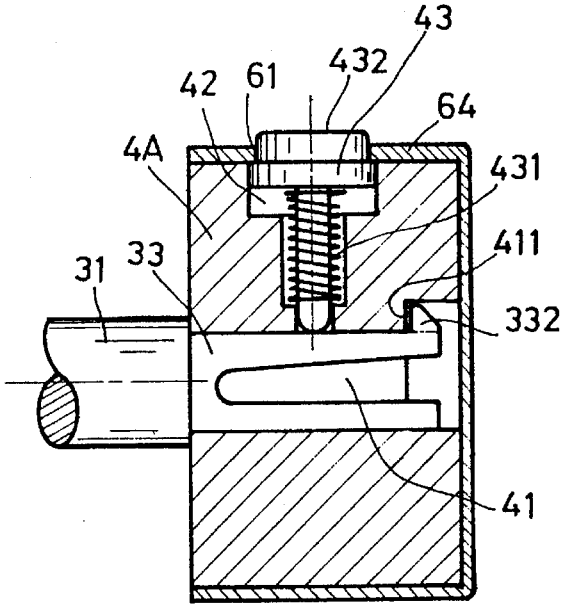
Figure 9:
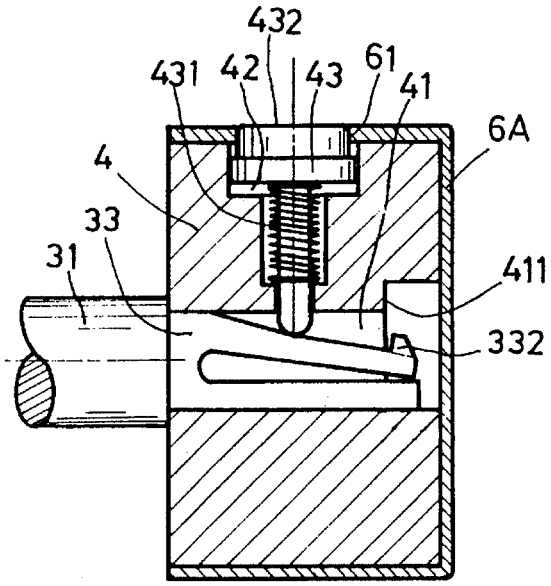

Referring to FIG. 9, the axle 31 of the base frame 3A or 3B terminates in a split coupling rod 33 for connection to the locating member 4A or 4B. The split coupling rod 33 is separated into two parts by a split 331, having two raised portions 322 at one side separated by a gap 333. The locating member 4A or 4B comprises a rectangular mounting hole 41 at one end, a stop edge 411 inside the rectangular mounting hole 41, a countersunk hole 42 perpendicularly communicated with the rectangular mounting hole 41, a press-button 43 inserted into the countersunk hole 42 and supported on a spring 431 and having a head 432 extended out of a round hole 61 on the respective cover 6A or 6B.

Referring to FIG. 9A, when the split coupling rod 33 of the axle 31 is inserted into the rectangular mounting hole 41, the raised portions 332 are engaged with the stop edge 411, and therefore the axle 31 and the locating member 4A or 4B are fastened together.

Referring to FIG. 9B, when the press-button 43 is depressed, the split coupling rod 33 is compressed, causing the raised portions 332 to disengage from the stop edge 411, and therefore the axle 31 can be disconnected from the locating member 4A or 4B.

Figure 10:
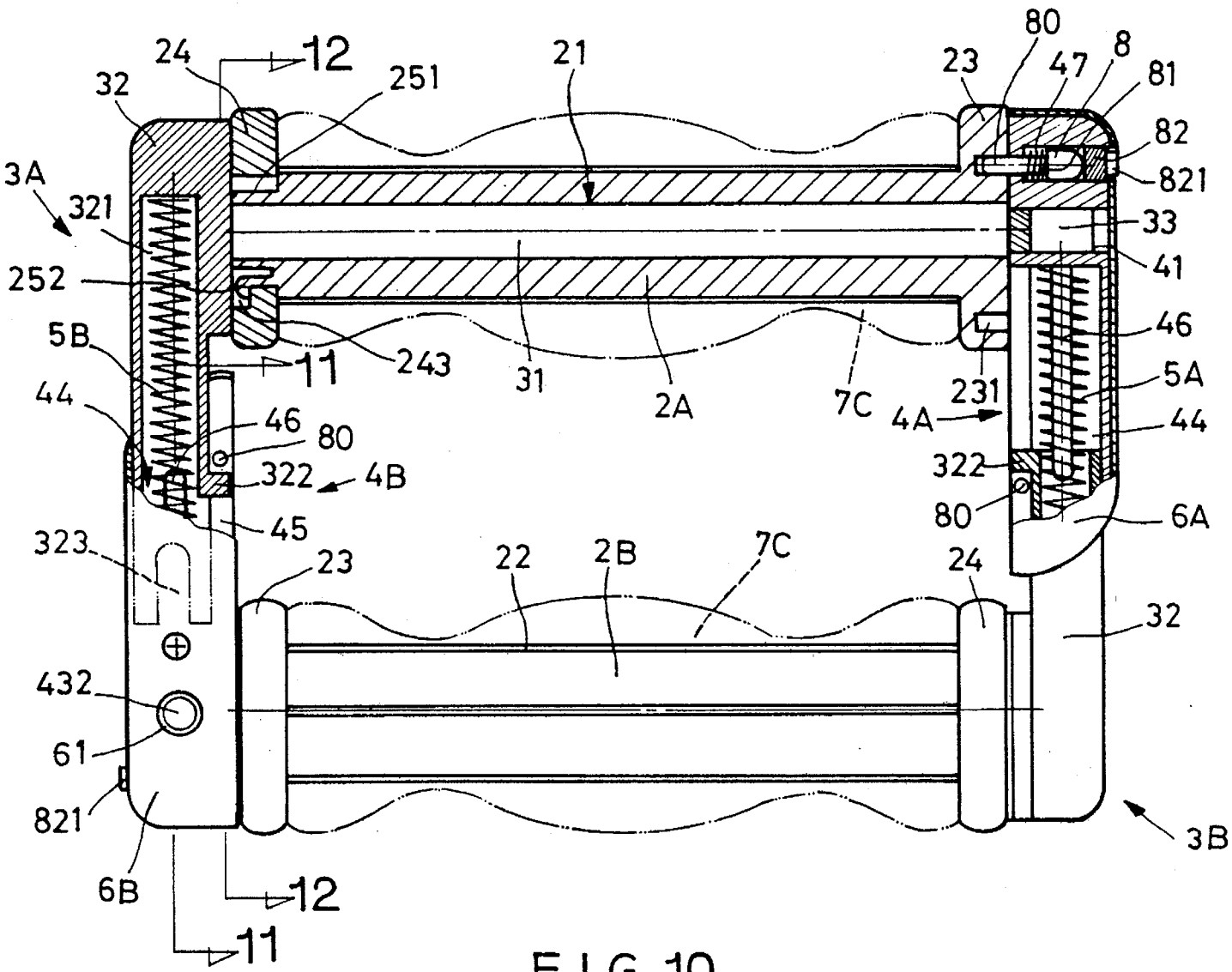
FIG. 10 is a sectional assembly view of the multifunctional spring-grip dumb-bell shown in FIG. 3.

Referring to FIG. 10 and FIG. 4 again, the base frame 3A and the locating member 4A are connected together byfastening the coupling rod 33 of the axle 31 of the base frame 3A to the rectangular mounting hole 41 on the locating member 4A, then the base frame 3B and the locating member 4B are connected together in the same manner, then the supporting bars 32 of the base frames 3A and 3B are respectively inserted into a respective longitudinal hole 44 on the locating member 4A or 4B. The locating member 4A or 4B comprises a post 46 inside the longitudinal hole 44, which holds one end of the spring 5A or 5B, a longitudinal sliding slot 45 at one side communicated with the longitudinal hole 44. The supporting bar 32 comprises a longitudinal chamber 321, which receives the spring 5A or 5B, a sliding rod 322 extended out of the longitudinal sliding slot 45 on the locating member 4A or 4B, and a side notch 323 at one lateral side.

Figure 11:
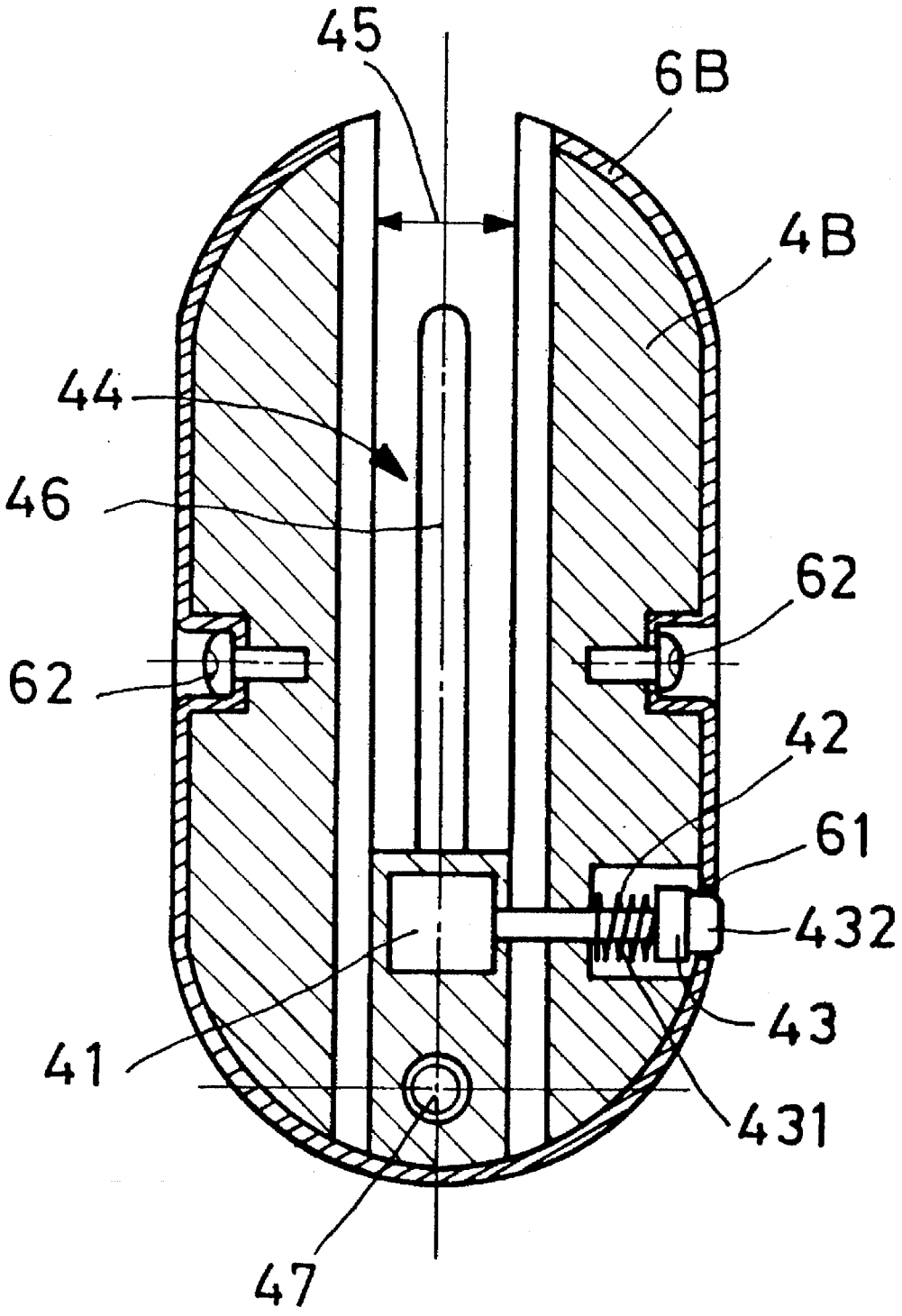
FIG. 11 is a sectional view taken along line 11—11 of FIG. 10.
Figure 12:
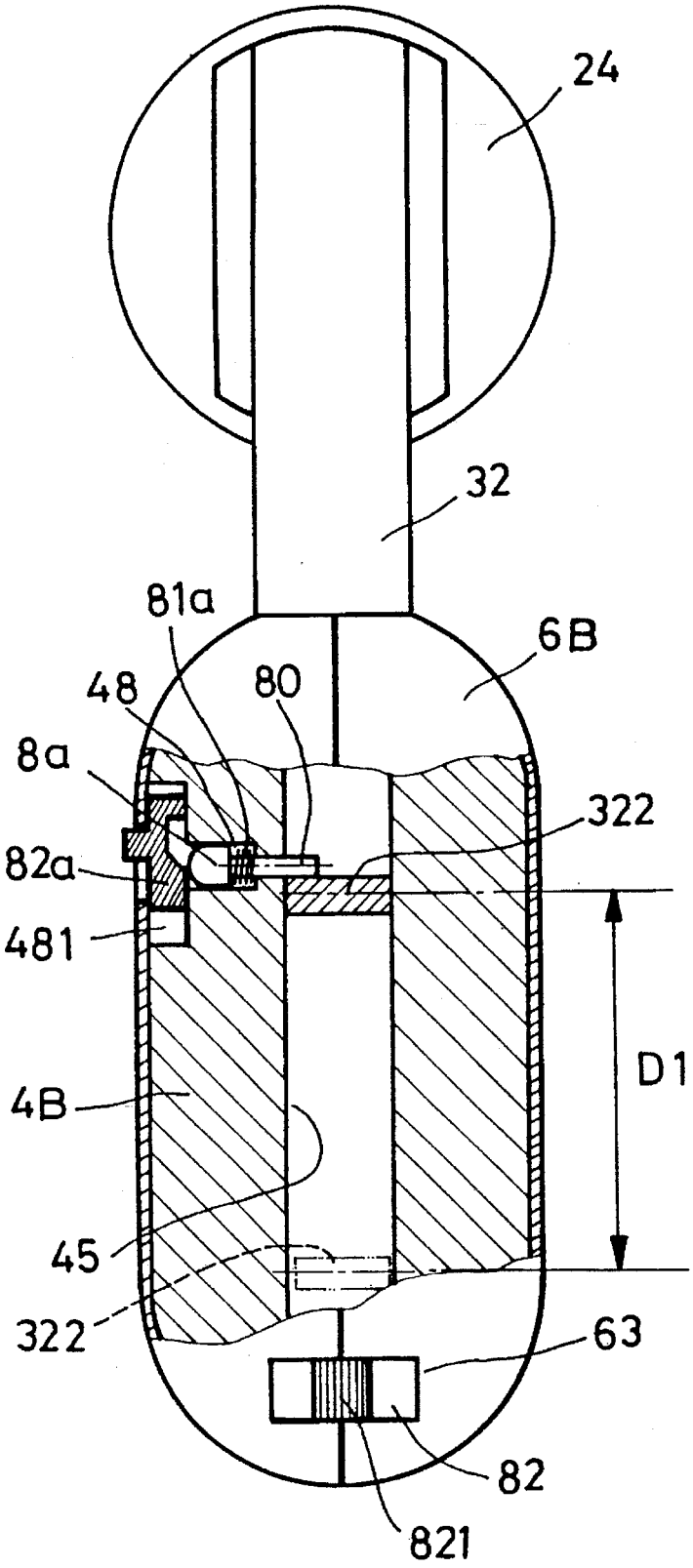
FIG. 12 is a sectional view taken along line 12—12 of FIG. 10.

Referring to FIGS. 11 and 12, and FIG. 4 again, the locating member 4A or 4B further comprises a sliding groove 471 adjacent to the rectangular mounting hole 41, a countersunk hole 47 on the sliding groove 471, a stop bolt 8 inserted into the countersunk hole 47 and supported on a spring 81, an ON/OFF sliding switch 82 moved in the sliding groove 471 and having a finger rod 821 extended out of an elongated hole 63 on the cover 6A or 6B, a sliding groove 481 at one side opposite to the press-button 43, a countersunk hole 48 on the sliding groove 481, a stop bolt 8*a* inserted into the countersunk hole 48 and supported on a spring 81*a*, an ON/OFF sliding switch 82*a* moved in the sliding groove 481. The stop bolt 8*a* has a front end 80 inserted into the longitudinal hole 44 to stop the sliding rod 322 in the longitudinal sliding slot 45. Therefore, the supporting bar 32 can be moved in the longitudinal hole 44 within a distance D1 defined by the stop bolt 8*a* (see FIG. 12), i.e., the barrels 2A and 2B can be moved relative to each other within the distance D1. When the barrels 2A and 2B are released, they are immediately returned to their former positions by the springs 5A and 5B.

Figure 13:
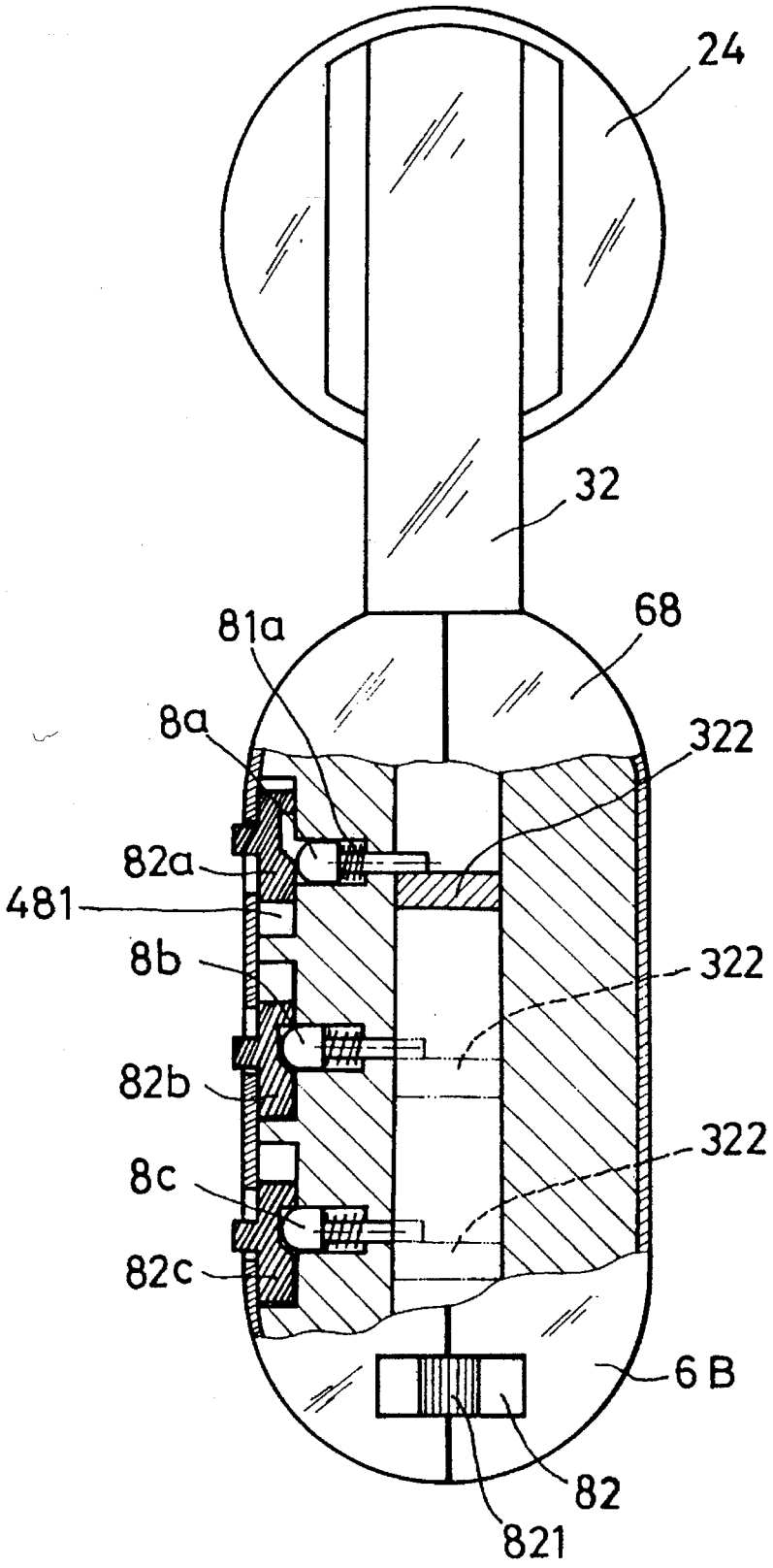
FIG. 13 is similar to FIG. 12 but showing additional stop bolts installed in the locating member at different locations to limit the movement of the supporting bar of the base frame.

Referring to FIG. 13, move stop bolts 8*b*, 8*c* can be installed in the locating member 4A or 4B and controlled by a respective ON/OFF sliding switch 82*b*, 82*c* to control different movement distances of the supporting bar 32 in the longitudinal hole 44.

The assembly process of the multifunctional spring-grip dumb-bell is simple and outlined hereinafter.

1. The desired sleeves 7 (7A, 7B, 7C) are respectively mounted around the barrels 2A and 2B and and fixed in place by the annular end caps 24 (see FIGS. 5, 6, 7, and 8). If to replace the sleeves 7, the hooks 252 are disengaged from the retaining grooves 243, and then the annular end caps 24 are respectively disconnected from the annular-extensions 25 of the barrels 2A and 2B, and therefore the sleeves 7 can be removed from the barrels 2A and 2B for a replacement. When the sleeve 7 is sleeved on the barrel 2A or 2B, the outer end 72 of the sleeve 7 protrudes over one end of the barrel 2A or 2B and spaced around the annular extension 25, therefore the sleeve 7 can be conveniently removed from the barrel 2A or 2B when the annular end cap 24 is disconnected from the annular extension 25.

2. The barrels 2A and 2B are respectively mounted around the axles 31 of the base frames 3A and 3B, then the coupling rods 33 of the axles 31 of the base frames 3A and 3B are respectively fastened to the rectangular mounting holes 41 on the locating members 4A and 4B (see FIG. 9).

3. The springs 5A and 5B are respectively connected between the supporting bars 32 of the base frames 3A and 3B and the locating members 4A and 4B, and therefore the base frames 3A and 3B and the locating members 4A and 4B are connected into a substantially rectangular open frame as shown in FIG. 10.

4. The aforesaid press-buttons 43, stop bolts 8 and 8*a* and ON/OFF sliding switches 82 and 82*a* are respectively installed in the locating members 4A and 4B, and then the covers 6A and 6B are fastened to the locating members 4A and 4B by screws 62 to hold the press-button and the ON/OFF sliding switches 82 and 82*a* in place.

5. When the covers 6A and 6B are fastened to the locating members 4A and 4B, the supporting bars 32 of the base frames 3A and 3B are respectively inserted into the longitudinal holes 44 on the locating members 4A and 4B, the sliding rods 322 of the supporting bars 32 are extended out of the longitudinal sliding slots 45 on the locating members 4A and 4B and stopped in place by the front ends 80 of the respective stop bolts 8.

6. When the ON/OFF sliding switches 82 are respectively moved to "ON" position, the front ends 80 of the stop bolts 8 are respectively forced into respective axial pin holes 231 on the barrels 2A and 2B, and therefore the barrels 2A and 2B are prohibited from rotary motion relative to the axles 31 of the base frames 3A and 3B.

7. The side notches 323 on the supporting bars 32 impart a space for allowing the supporting bars 32 of the base frames 3A and 3B to be moved in the longitudinal holes 44 on the locating members 4A and 4B without being hindered by the press-buttons 43.

8. If to replace the springs 5A and 5B or the sleeves 7, the ON/OFF sliding switches 82*a* are respectively moved to "OFF" position for allowing the supporting bars 32 of the base frames 3A and 3B to be respectively disconnected from the locating members 4A and 4B. When the supporting bars 32 are respectively disconnected from the locating members 4A and 4B, the springs 5A and 5B can then be removed from the base frames 3A and 3B and the locating members 4A and 4B and replaced by a respective spring of different spring force. When the annular end caps 24 are respectively disconnected from the barrels 2A and 2B, the sleeves 7 can then be removed from the barrels 2A and 2B for a replacement.

The multifunctional spring-grip dumb-bell can be operated in different manners for different purposes.

Figure 14:
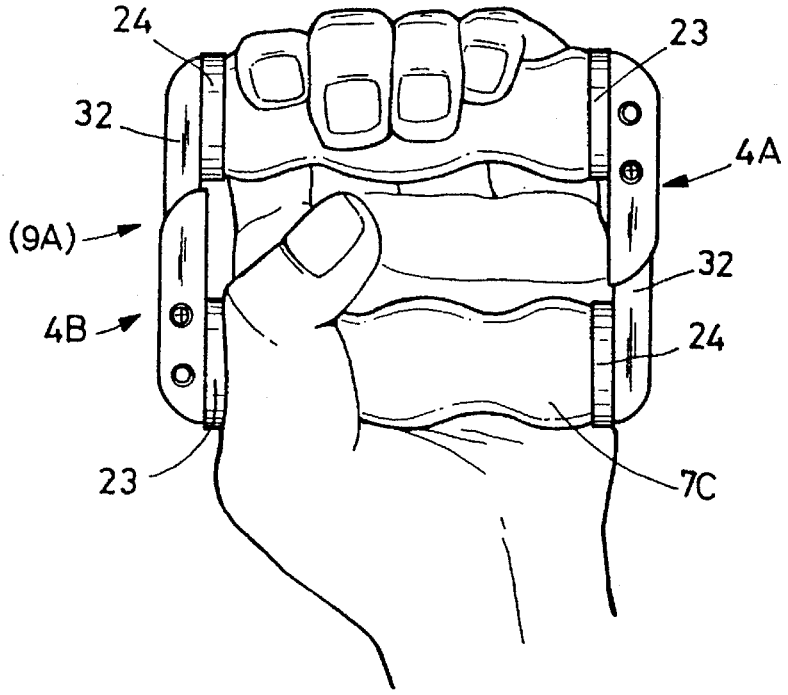
FIGS. 14 and 15 show the multifunctional spring-grip dumb-bell grasped in the hand used as a hand muscle developer.
Figure 15:
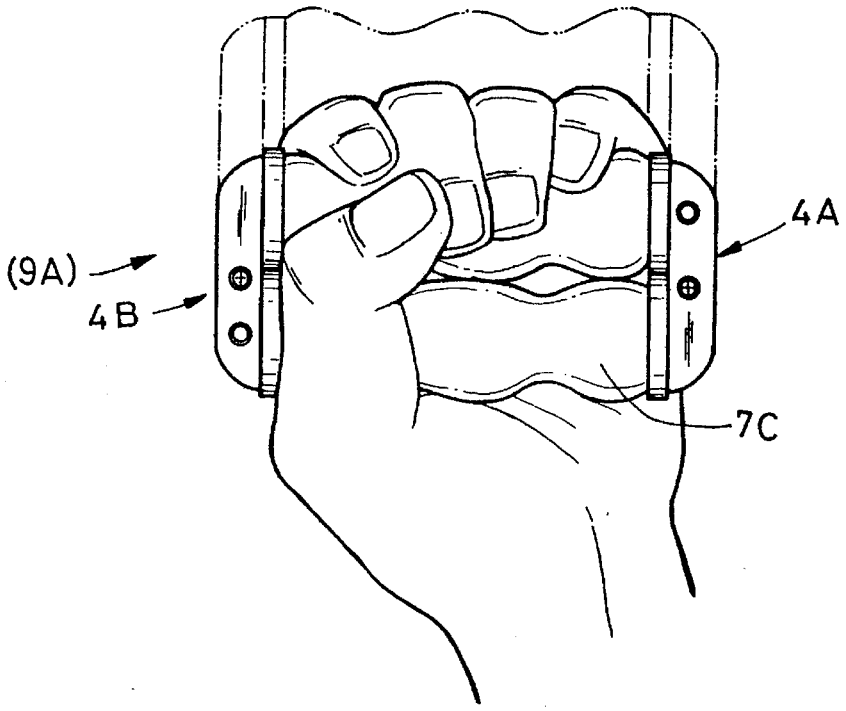

OPERATIONAL EXAMPLE I:

As illustrated in FIGS. 14 and 15, the multifunctional spring-grip dumb-bell can be used as a hand muscle developer 9A and grasped in the hand to exercise the muscles of the hand. In this case, the sleeves 7C or 7B can be alternatively used.

Figure 16:
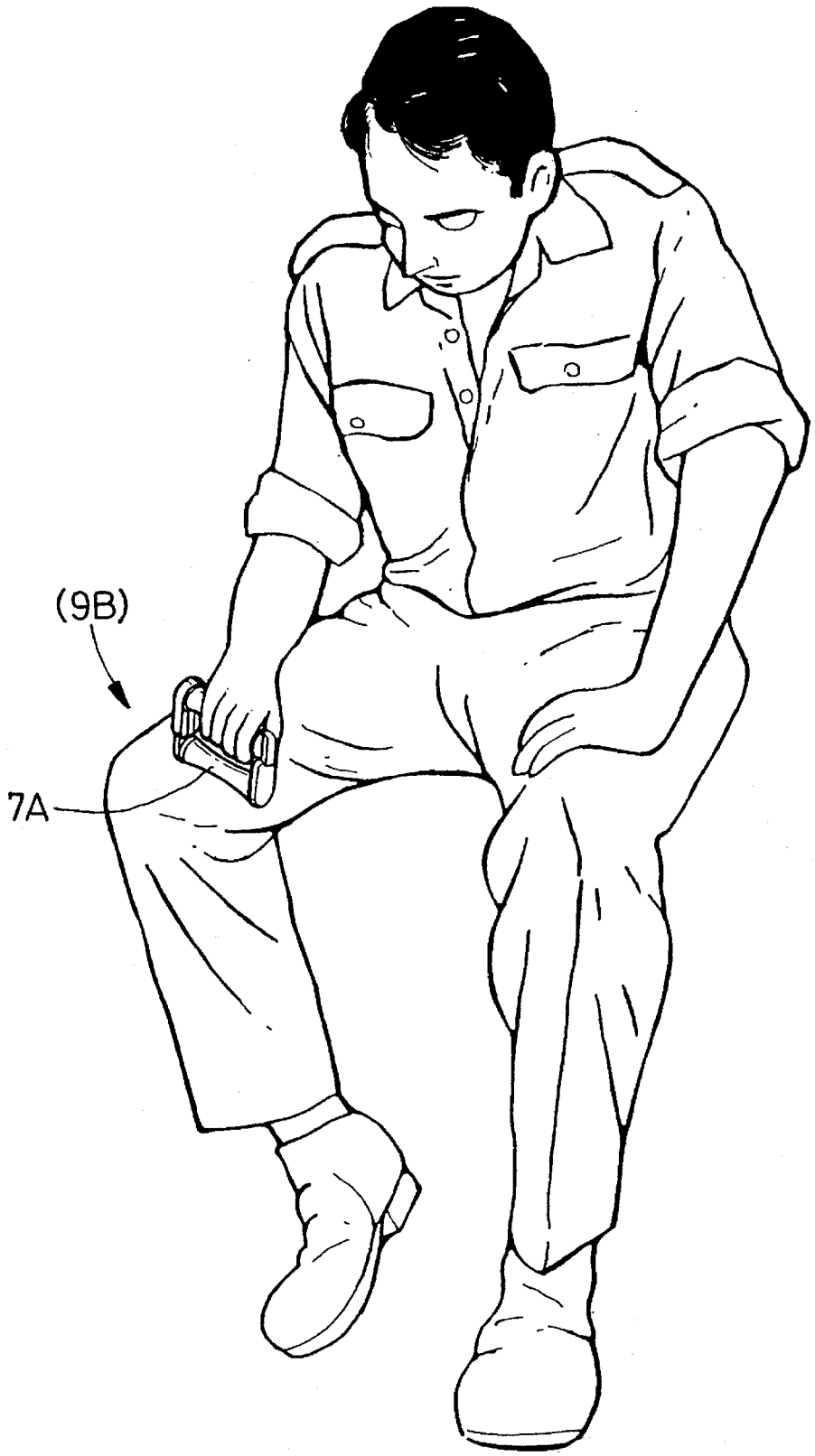
FIG. 16 shows the multifunctional spring-grip dumb-bell used as a hand massager and moved over the thigh to massage the muscles.

OPERATIONAL EXAMPLE II:

As illustrated in FIG. 16, the multifunctional spring-grip dumb-bell can be used as a hand massager 9B. In the case, the sleeves 7A are used, the barrel 2A is fixed in position and held in the hand, and the barrel 2B is turned round the respective axle 31 and moved against the body to massage the muscles and joints.

Figure 17:
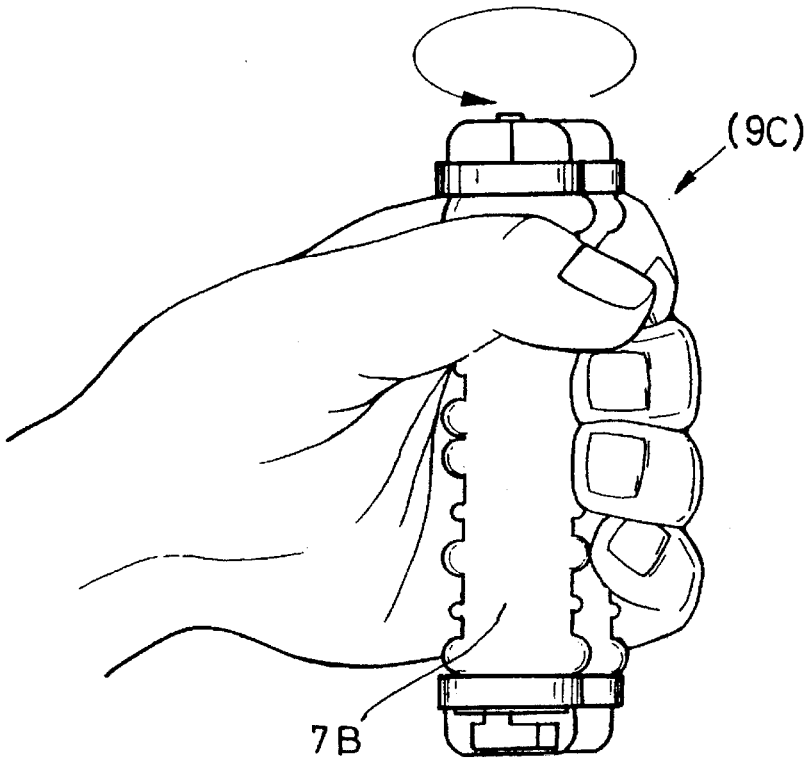
Figure 18:
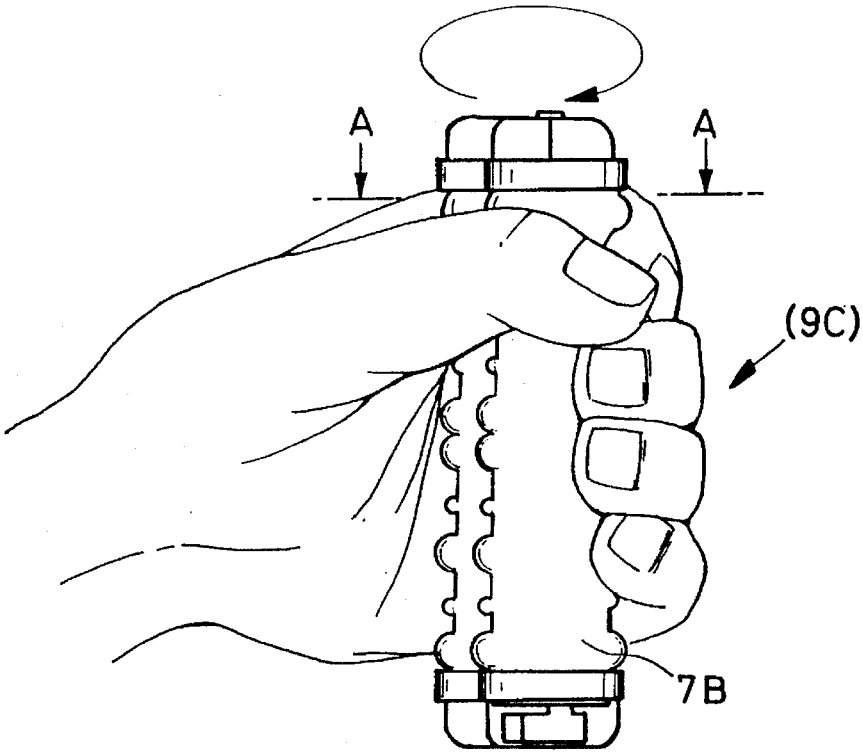
Figure 18:
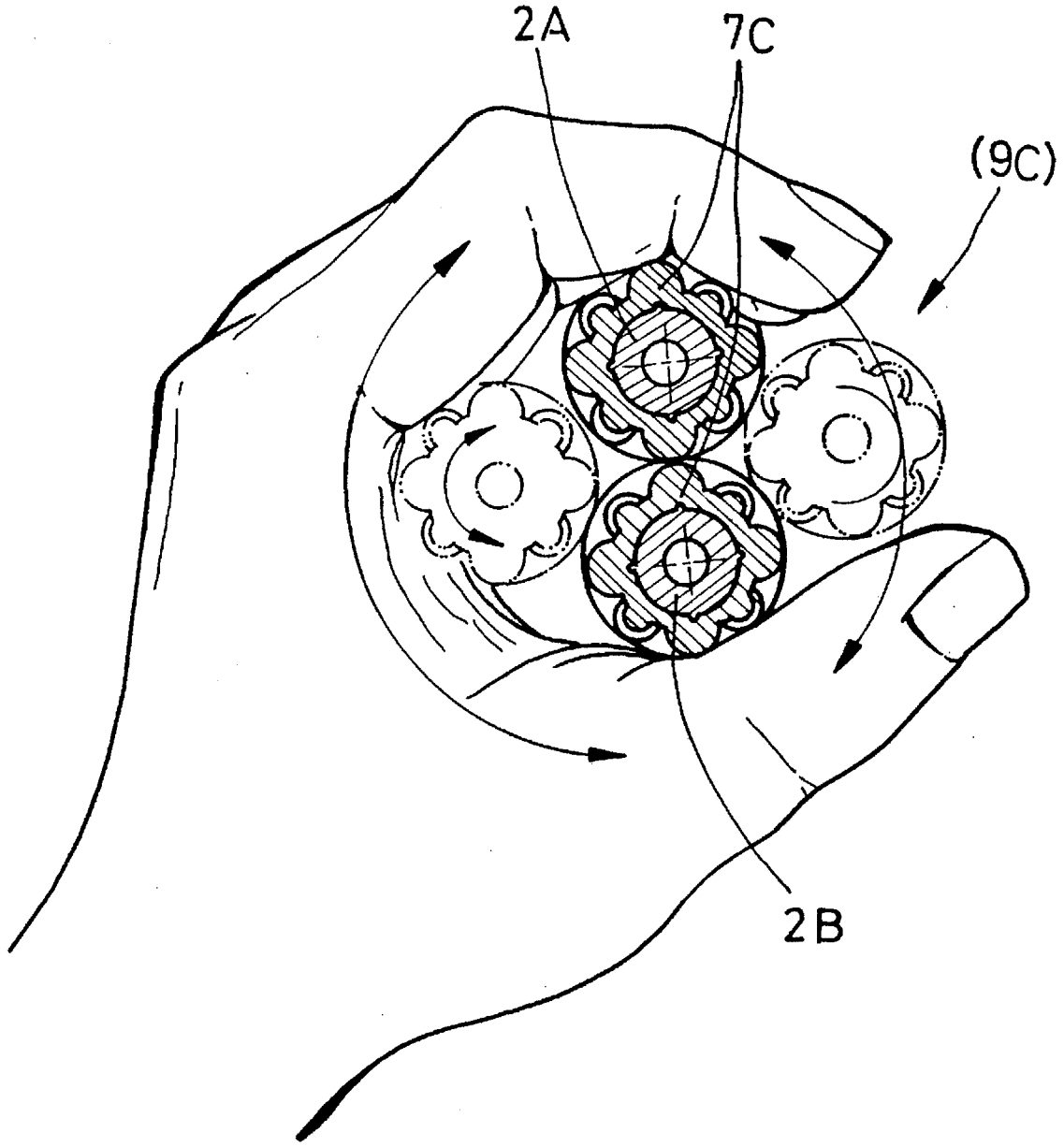

OPERATIONAL EXAMPLE III:

As illustrated in FIGS. 17 and 18, the multifunctional spring-grip dumb-bell can be used as a palm massager 9C. In this case, the barrels 2A and 2B are moved toward each other and then locked in the closed position relative to each other by the stop bolts 8*c* (see FIG. 13). Therefore, the barrels 2A and 2B can be turned round the respective axles 31 relative to each other to massage the palm and to exercise the fingers (see FIG. 18A).

Figure 19:
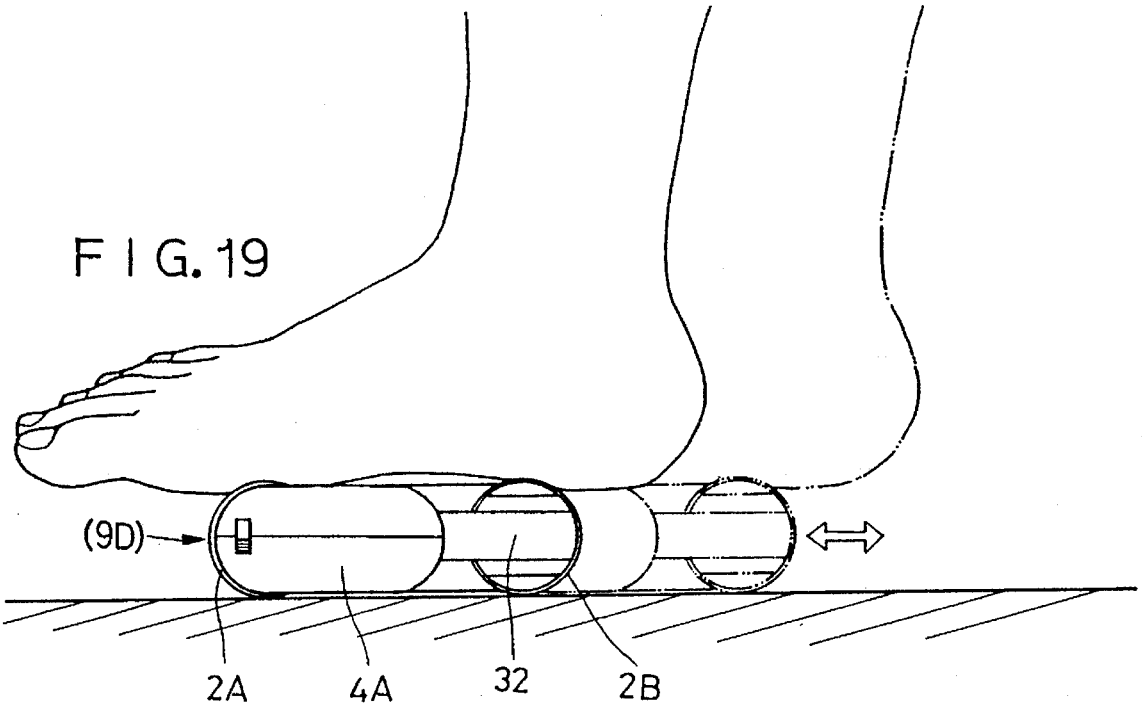
FIGS. 19 and 20 show the multifunctional spring-grip dumb-bell used as a sole massager.
Figure 20:
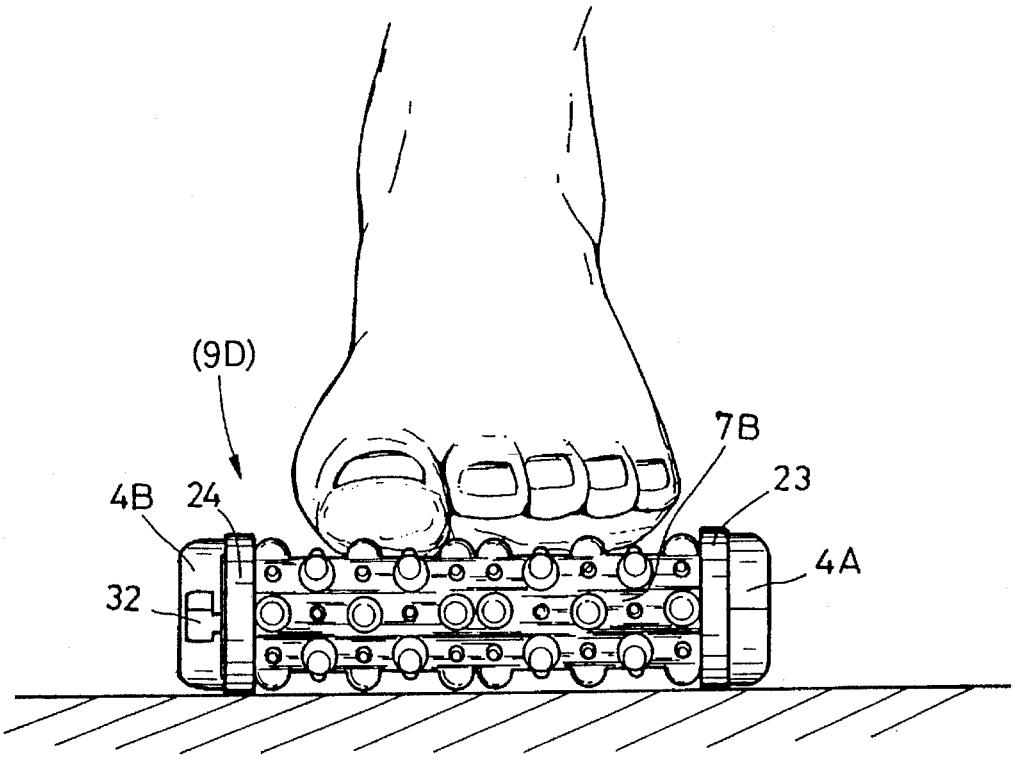

OPERATIONAL EXAMPLE IV:

As illustrated in FIGS. 19 and 20, the multifunctional spring-grip dumb-bell can be used as a sole massager 9D. When the spring-grip dumb-bell 9D is placed on the ground, the barrels 2A and 2B are supported on the ground by the outward flanges 23 and the annular end caps 24 and can be turned around the respective axles 31 by the feet. When the barrels 2A and 2B are turned round the axles 31 by the feet, the soles of the feet are massaged.

It is to be understood that the drawings are designed for purposes of illustration only, and are not intended as a definition of the limits and scope of the invention disclosed.

What is claimed is:

1. A multifunctional spring-grip dumb-bell comprising:

a first base frame having an axle and a supporting bar integrally formed to a first end of said axle, said supporting bar extending perpendicularly from said axle;

a first locating member having a first end releasably coupled to a second end of said first base frame axle, said first locating member extending in a perpendicular direction with respect to an extension direction of said first base frame axle;

a second base frame having a second base frame axle parallel to said first base frame axle and a second base frame supporting bar integrally formed to a first end of said second base frame axle, said second base frame supporting bar extending perpendicularly from said second base frame axle, said second base frame supporting bar extending in a parallel direction with respect to said first base frame supporting bar, said second base frame supporting bar being slidably engaged to a second end of said first locating member;

a second locating member having a first end releasably coupled to a second end of said second base frame axle, said second locating member extending in parallel direction with respect to said first locating member, said second locating member having a second end slidably engaged to said first base frame supporting bar;

first spring means connected between the supporting bar of said first base frame and the second end of said second locating member for resiliently biasing said first base frame supporting bar and said second locating member;

second spring means connected between the supporting bar of said second base frame and the second end of said first locating member for resiliently biasing said second base frame supporting bar and said first locating member;

first and second barrels rotatably mounted respectively on said first and second base frame axles;

two locking means respectively mounted on said locating members for controlling the locking of said barrels in a predetermined position, for prohibiting said barrels from rotary motion relative to the axles of said first and second base frames; and two covers respectively fastened to said locating members by screws.

2. The multifunctional spring-grip dumb-bell of claim 1 wherein said barrels each comprises:

a barrel body having a plurality of longitudinal ribs around the periphery, an outward flange radially extended outwards at one end defining a plurality of axial pin holes around the border for engagement with said locking means, an annular extension longitudinally extended outwards at an opposite end, a key and a hook raised from said annular extension at two opposite locations;

a sleeve sleeved onto said barrel body, having a plurality of longitudinal grooves on the inside respectively engaged with the longitudinal ribs on said barrel body; and an annular end cap fastened to the annular extension of said barrel body to hold down said sleeve, said annular end cap comprising a center through hole, which receives said annular extension, a key way engaged with the key of said barrel body, and a retaining groove engaged with the hook of said barrel body.

3. The multifunctional spring-grip dumb-bell of claim 2 wherein said sleeve is molded from flexible rubber, of which the outer diameter is made gradually bigger toward two opposite ends.

4. The multifunctional spring-grip dumb-bell of claim 2 wherein said sleeve has a plurality of raised portions around the periphery.

5. The multifunctional spring-grip dumb-bell of claim 2 wherein said sleeve has a wave-like outside wall.

6. The multifunctional spring-grip dumb-bell of claim 1 wherein the axle of each base frame terminates in a split coupling rod for connection to said locating members, said split coupling rod having two raised portions at one side separated by a gap; the first end of each locating member has a rectangular mounting hole, which receives the split coupling rod of the axle of one base frame, and a stop edge inside said rectangular mounting hole, which engages with the raised portions of the split coupling rod upon its insertion into said rectangular mounting hole.

7. The multifunctional spring-grip dumb-bell of claim 6 wherein the first end of each locating member further comprises a countersunk hole perpendicularly communicated with said rectangular mounting hole, a press-button mounted in said countersunk hole and supported by a spring and having a head extended out of a hole on the cover on the respective locating member, said press-button being depressed to release the raised portions of the split coupling rod of the respective axle from the respective stop edge for permitting the respective axle to be disconnected from the respective locating member.

8. The multifunctional spring-grip dumb-bell of claim 7, wherein:

said second end of each said locating member includes a longitudinal hole, a sliding slot communicated with said longitudinal hole and a post located internal said longitudinal hole to hold said spring means; and, said first and second base frame supporting bars being respectively displaceably inserted into the longitudinal hole of said second and first locating members, said first and second base frame supporting bars including a sliding rod slidingly engaging and protruding through said second and first locating member sliding slots, respectively, and a side notch corresponding to said press-button of said second and first locating members.

9. The multifunctional spring-grip dumb-bell of claim 1 wherein each locking means comprises a sliding groove on the respective locating member, a countersunk hole on said sliding groove, a stop bolt inserted into said countersunk hole and supported on a spring, an ON/OFF sliding switch moved in said sliding groove between "ON" position and "OFF" position, said stop bolt being forced into the locking position to lock the respective barrel in position when said ON/OFF sliding switch is switched to "ON" position, said stop bolt being released from the respective barrel for allowing it to be turned round the respective axle when said ON/OFF sliding switch is switched to "OFF" position.

10. The multifunctional spring-grip dumb-bell of claim 1 further comprises a plurality of stop means respectively installed in said locating members and controlled to limit the movement distance of the supporting members of said base frames relative to said locating members.

* * * * *